US009906861B2

(12) United States Patent
Liu et al.

(10) Patent No.: US 9,906,861 B2
(45) Date of Patent: Feb. 27, 2018

(54) TWEETER AND METHOD FOR REALIZING OMNIDIRECTIONAL HIGH PITCH SOUND FIELD

(71) Applicant: Goertek, Inc., Weifang, ShanDong Province (CN)

(72) Inventors: Song Liu, Weifang (CN); Yitao Liu, Weifang (CN)

(73) Assignee: Goertek, Inc., Weifang, Shangdong Province (CN)

( * ) Notice: Subject to any disclaimer, the term of this patent is extended or adjusted under 35 U.S.C. 154(b) by 1 day.

(21) Appl. No.: 14/901,611

(22) PCT Filed: Jul. 30, 2015

(86) PCT No.: PCT/CN2015/085582
§ 371 (c)(1),
(2) Date: Dec. 28, 2015

(87) PCT Pub. No.: WO2016/065962
PCT Pub. Date: May 6, 2016

(65) Prior Publication Data

US 2016/0309257 A1 Oct. 20, 2016

(30) Foreign Application Priority Data

Oct. 30, 2014 (CN) ..... 2014 1 0598848

(51) Int. Cl.
*H04R 5/02* (2006.01)
*H04R 1/30* (2006.01)
(Continued)

(52) U.S. Cl.
CPC ..... *H04R 5/02* (2013.01); *H04R 1/323* (2013.01); *H04R 1/403* (2013.01); *H04R 31/006* (2013.01);
(Continued)

(58) Field of Classification Search
CPC . H04R 1/30; H04R 1/345; H04R 1/24; H04R 1/403; H04R 1/323
(Continued)

(56) References Cited

U.S. PATENT DOCUMENTS 6,035,051 A * 3/2000 Sato ..... H04R 5/02 181/152
2008/0192964 A1* 8/2008 Iwayama ..... H04R 1/26 381/182
2014/0193019 A1* 7/2014 Yan ..... H04R 1/30 381/342

FOREIGN PATENT DOCUMENTS

CN 102438190 5/2012

OTHER PUBLICATIONS

PCT/CN2015/085582,Written Opinion of the International Searching Authority dated Sep. 29, 2015, 4 pages and English Translation, 4 pages.

* cited by examiner

*Primary Examiner* — George Monikang
(74) *Attorney, Agent, or Firm* — Boyle Fredrickson, S.C.

(57) ABSTRACT

The present invention discloses a tweeter and a method for realizing omnidirectional high pitch sound field. The tweeter has advantages of small volume and low cost and comprises a first tweeter unit corresponding to a left sound track, a second tweeter unit corresponding to a right sound track, a radiation structure formed by a plurality of horns. In this technical solution, the tweeter has stereo effect and realizes 360° sound field of the high pitch portion with a smaller volume by disposing that the number of the horns of the left sound track is the same as the number of the horns of the right sound track in the radiation structure, the horns of the
(Continued)

left sound track and the horns of the right sound track are disposed at intervals, and the plurality of horns are disposed evenly on a whole plane.

14 Claims, 6 Drawing Sheets

(51) Int. Cl.
*H04R 1/32* (2006.01)
*H04R 1/40* (2006.01)
*H04R 31/00* (2006.01)
*H04R 1/34* (2006.01)

(52) U.S. Cl.
CPC ..... *H04R 1/345* (2013.01); *H04R 2205/022* (2013.01)

(58) Field of Classification Search
USPC ..... 381/339, 340, 342
See application file for complete search history.

TWEETER AND METHOD FOR REALIZING OMNIDIRECTIONAL HIGH PITCH SOUND FIELD

TECHNICAL FIELD

The invention relates to acoustic technology, in particular to a tweeter and a method for realizing omnidirectional high pitch sound field.

DESCRIPTION OF RELATED ART

Along with the accumulation of social wealth and the accelerated pace of life, higher requirements for life quality have been put forward. And beautiful music is an indispensable part of it. As the source of music, audio equipment is widely used in our life, work, study and entertainment.

Traditional audio equipment often adopts multiple mono tracks and cooperate them with a plurality of reflectors like metope to realize even distribution of sound field in operating environment. However, the whole audio system is not only bulky but costly. To adapt to the accelerated life rhyme, it is more urgent to realize portability and versatility of the audio equipment, and higher requirements have been put forward for volume miniaturization and omnidirectional sound field of the audio equipment.

In order to realize omnidirectional high pitch sound field, the existing way is to realize a dome tweeter using a horn with a phase cone, but this solution is only adaptive for mono but cannot realize stereo; and the other way is that multi tweeter units make sound simultaneously, but this solution costs highly and cannot fully guarantee that stereo can surround 360° in a sound field.

BRIEF SUMMARY OF THE INVENTION in view of the above problems, the invention provides a tweeter and a method for realizing omnidirectional high pitch sound field to solve or at least partially solve the above problems. The technical solution of the embodiments of the present invention is realized as follows:

In one aspect, the embodiment of the invention provides a tweeter, comprising:

a first tweeter unit corresponding to a left sound track, a second tweeter unit corresponding to a right sound track, and a radiation structure formed by a plurality of horns;

in the radiation structure, the number of the horns of the left sound track is the same as the number of the horns of the right sound track, and the horns of the left sound track and the horns of the right sound track are disposed at intervals;

the first tweeter unit and the second tweeter unit are assembled on the radiation structure, respectively, a diaphragm of the first tweeter unit and a diaphragm of the second tweeter unit are disposed oppositely, each of the horns of the left sound track is provided with a first sound track opening only for the first tweeter unit, sound waves of the left sound track radiated by the first tweeter unit enter the horns of the left sound track along the first sound track openings; each of the horns of the right sound track is provided with a second sound track opening only for the second tweeter unit, sound waves of the right sound track radiated by the second tweeter unit enter the horns of the right sound track along the second sound track openings.

Preferably, the plurality of horns are disposed evenly on a whole plane, wherein the number of the horns of the left sound track is two or more, and correspondingly, the number of the horns of the right sound track is also above two or more.

Preferably, the tweeter also comprises: a first sealing foam matching the first tweeter unit, a second sealing foam matching the second tweeter unit, wherein the first sealing foam can surround the first tweeter unit without contacting the diaphragm of the first tweeter unit, and the second sealing foam can surround the second tweeter unit without contacting the diaphragm of the second tweeter unit;

the first tweeter unit and the second tweeter unit are assembled on the radiation structure via the first sealing foam and the second sealing foam, respectively.

Preferably, the tweeter also comprises: a first phase cone and a second phase cone; the first phase cone is fixed by a support frame symmetrically disposed on the horns of the left sound track and located in front of the diaphragm of the first tweeter unit; and the second phase cone is fixed by a support frame symmetrically disposed on the horns of the right sound track and located in front of the diaphragm of the second tweeter unit.

Based on the above solution, a central axis of the first tweeter unit coincides with a central axis of the second tweeter unit, or a central axis of the first tweeter unit does not coincide with a central axis of the second tweeter unit.

In the above technical solution, when the central axis of the first tweeter unit coincides with the central axis of the second tweeter unit, the horns of the left sound track and the horns of the right sound track are symmetrical in position.

In the above technical solution, when the central axis of the first tweeter unit does not coincide with the central axis of the second tweeter unit, the horns of the left sound track and the horns of the right sound track are not symmetrical in position.

In the above technical solution, when the central axis of the first tweeter unit does not coincide with the central axis of the second tweeter unit, the first tweeter unit partially overlaps the second tweeter unit in the axial direction.

The tweeter provided in the embodiments of the invention has advantages of simple structure, small volume and low cost. By disposing the horns of the left sound track and the horns of the right sound track at intervals, the tweeter has stereo effect. In the preferred solution, by disposing all of the horns evenly on a whole plane, the sound wave emitted by the horns can cover horizontal 360°, effectively solving the problem in the acoustic structure of the prior art that 360° surround stereo cannot be realized under the general request of miniaturization and low cost.

On the other aspect, the embodiments of the invention provide a method for realizing omnidirectional high pitch sound field, comprising:

providing a first tweeter unit corresponding to a left sound track and a second tweeter unit corresponding to a right sound track;

providing a radiation structure formed by a plurality of horns, wherein the plurality of horns are disposed evenly on a whole plane, and in the radiation structure, the number of the horns of the left sound track is the same as the number of the horns of the right sound track, and the horns of the left sound track and the horns of the right sound track are disposed at intervals;

assembling the first tweeter unit and the second tweeter unit on the radiation structure, respectively.

disposing a diaphragm of the first tweeter unit and a diaphragm of the second tweeter unit oppositely; providing each of the horns of the left sound track with a first sound track opening only for the first tweeter unit such that sound waves of the left sound track radiated by the first tweeter unit enter the horns of the left sound track along the first sound track openings; providing each of the horns of the right sound track with a second sound track opening only for the second tweeter unit such that sound waves of the right sound track radiated by the second tweeter unit enter the horns of the right sound track along the second sound track openings.

Preferably, disposing the plurality of horns evenly on a whole plane, wherein the number of the horns of the left sound track is two or more, and correspondingly, the number of the horns of the right sound track is also two or more.

Preferably, providing a first sealing foam matching the first tweeter unit, and a second sealing foam matching the second tweeter unit, wherein the first sealing foam can surround the first tweeter unit without contacting the diaphragm of the first tweeter unit, and the second sealing foam can surround the second tweeter unit without contacting the diaphragm of the second tweeter unit.

Assembling the first tweeter unit and the second tweeter unit on the radiation structure respectively comprises:

assembling the first tweeter unit and the second tweeter unit on the radiation structure via the first sealing foam and the second sealing foam respectively.

Preferably, the above method further comprises:

disposing a first phase cone and a second phase cone, wherein the first phase cone is fixed by a support frame symmetrically disposed on the horns of the left sound track and located in front of the diaphragm of the first tweeter unit; and the second phase cone is fixed by a support frame symmetrically disposed on the horns of the right sound track and located in front of the diaphragm of the second tweeter unit.

In the above solution, the central axis of the first tweeter unit coincides with the central axis of the second tweeter unit, or the central axis of the first tweeter unit does not coincide with the central axis of the second tweeter unit.

Preferably, when the central axis of the first tweeter unit coincides with the central axis of the second tweeter unit, dispose the horns of the left sound track and the horns of the right sound track to be symmetrical in position.

Or preferably, when the central axis of the first tweeter unit does not coincide with the central axis of the second tweeter unit, dispose the horns of the left sound track and the horns of the right sound track to be not symmetrical in position, or dispose the first tweeter unit to partially overlap the second tweeter unit in the axial direction.

With the method for realizing omnidirectional high pitch sound field provided by the embodiments of the present invention, by disposing the horns of the left sound track and the horns of the right sound track at intervals, stereo effect is realized; and by disposing all of the horns evenly in a whole plane, the sound wave emitted by the horns can cover horizontal 360°, effectively solving the problem in the acoustic structure of the prior art that 360° surround stereo cannot be realized under the general request of miniaturization and low cost.

BRIEF DESCRIPTION OF THE SEVERAL VIEWS OF THE DRAWINGS

The drawings are provided for further understanding of the invention, and constitute a part of the description for explaining the present invention with the embodiments of the invention, but do not constitute limitation to the invention. In the drawings.

DETAILED DESCRIPTION OF THE INVENTION

Figure 1:
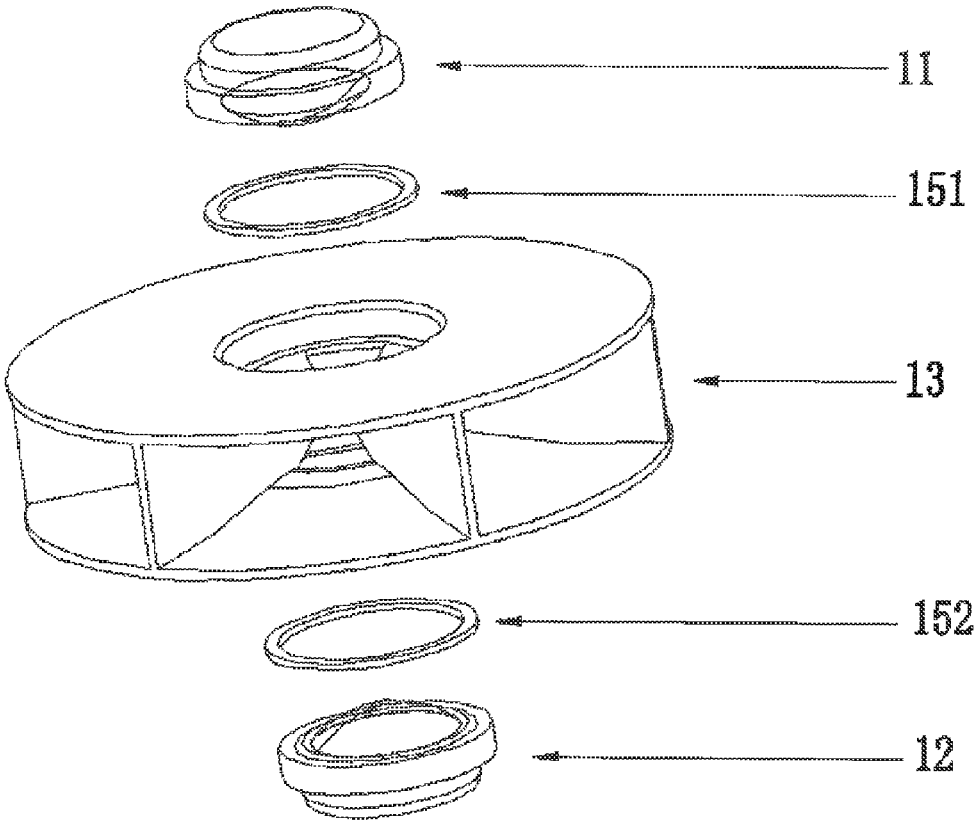
FIG. 1 is an explosive view of the assembly structure of a tweeter provided by an embodiment of the present invention.

To make the objectives, technical solutions and advantages of the present invention clearer, embodiments of the present invention will be described in detail hereinbelow with reference to the attached drawings.

As shown in FIGS. 1-5 all together, the tweeter provided in an embodiment of the present invention comprises: a first tweeter unit 11 corresponding to the left sound track, a second tweeter unit 12 corresponding to the right sound track, a radiation structure 13 formed by a plurality of horns (horns 141, horns 142), wherein the radiation structure 13 may be formed integrally or may be made up of separated components, the radiation structure 13 in this embodiment is formed integrally. In a deformed mode, the first tweeter unit 11 may also be used in the right sound track and the second tweeter unit 12 may also be used in the left sound track.

Figure 2:
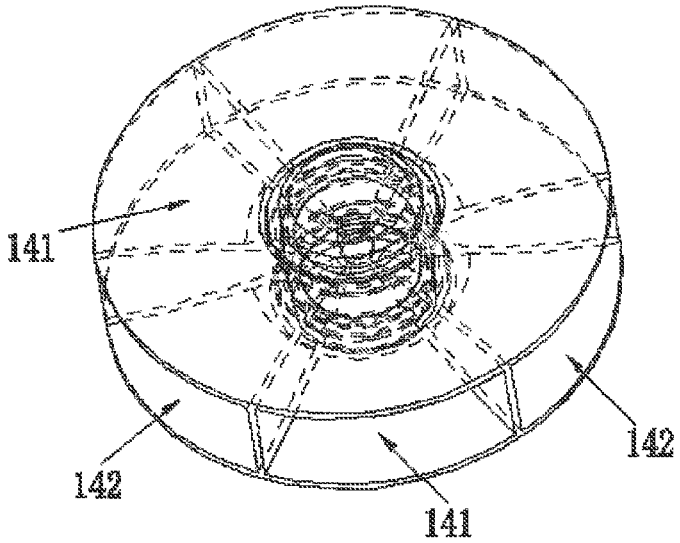
FIG. 2 is a perspective view of the assembly after the components in FIG. 1 have been assembled.

Referring to FIG. 2, it shows a perspective view of the assembly after the components in FIG. 1 have been assembled. In the radiation structure 13, the number of the horns of the left sound track is the same as the number of the horns of the right sound track, and the horns 141 of the left sound track and the horns 142 of the right sound track are disposed at intervals via partition walls, that is, the horns 141 of the left sound track are disposed adjacent the horns 142 of the right sound track, and the thickness of the partition walls between the horns can be adjusted according to actual needs.

Figure 3:
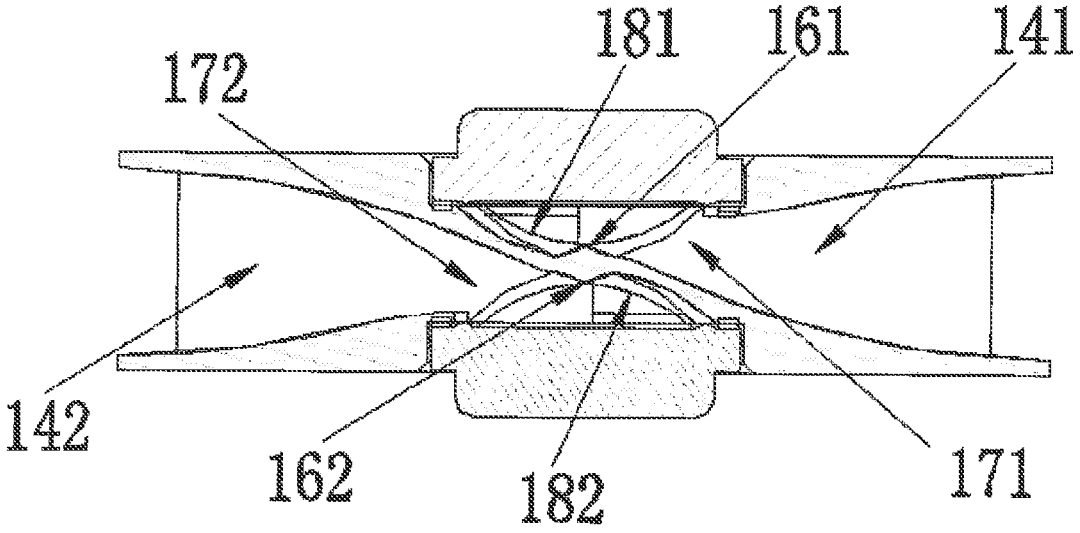
FIG. 3 is a section view of the assembly after the components in FIG. 1 have been assembled.

Referring to FIG. 3, it is a section view of the assembly after the components in FIG. 1 have been assembled. The first tweeter unit 11 and the second tweeter unit 12 are assembled on the radiation structure 13 respectively, a diaphragm 181 of the first tweeter unit 11 and a diaphragm 182 of the second tweeter unit 12 are disposed oppositely, each of the horns 141 of the left sound track is provided with a first sound track opening 171 only for the first tweeter unit 11, sound waves of the left sound track radiated by the first tweeter unit 11 enter the horns 141 of the left sound track along the first sound track openings 171, and finally spread from ventilation holes of the horns 141 to the space along the horns 141 of the left sound track; each of the horns 142 of the right sound track is provided with a second sound track opening 172 only for the second tweeter unit 12, sound waves of the right sound track radiated by the second tweeter unit 12 enter the horns 142 of the right sound track along the second sound track openings 172, and finally spread from ventilation holes of the horns 142 to the space along the horns 142 of the right sound track.

It should be noted that the two tweeter units (11, 12) and the radiation structure 13 are usually made from a material with great hardness. If they are assembled directly, there would be gaps, and the sound emitted from the two tweeter units may enter the radiation structure 13 through the gaps, thereby affecting the sound quality. In the present technical solution, a structure of sealing foam made from a flexible material is used for sealing the gaps generated by directly assembling the two tweeter units and the radiation structure, which not only realizes non-rigid connection by the foams but also guarantees the sound quality of the audio equipment.

Specifically, referring to FIG. 1, the first tweeter unit 11 and the second tweeter unit 12 are assembled on the radiation structure 13 via the first sealing foam 151 and the second sealing foam 152, respectively; the first sealing foam 151 matches the first tweeter unit 11, the second sealing foam 152 matches the second tweeter unit 12, the first sealing foam 151 can surround the first tweeter unit 11, namely, the sealing foam needs to match the tweeter unit in shape and size, the first sealing foam 151 does not contact the diaphragm 181 of the first tweeter unit 11, the second sealing foam 152 can surround the second tweeter unit 12 without contacting the diaphragm 182 of the second tweeter unit 12, thereby ensuring that the foam will not affect the vibration of the diaphragm.

Further, in the above embodiment, a tweeter unit having a phase cone is preferably selected. As shown in FIG. 3, the tweeter further comprises a first phase cone 161 provided for the first tweeter unit 11 and a second phase cone 162 provided for the second tweeter unit 12, wherein the first phase cone 161 is fixed by a support frame symmetrically disposed on the horns 141 of the left sound track and located in front of the diaphragm 181 of the first tweeter unit 11; and the second phase cone 162 is fixed by a support frame symmetrically disposed on the horns 142 of the right sound track and located in front of the diaphragm 182 of the second tweeter unit 12. The structure of phase cones helps sound diverge more evenly to the horns of both left and right sound tracks. Symmetrical disposition of support frames on the corresponding horns for each of the phase corns helps the sound diverge more evenly.

For example, FIG. 3 shows positive radiation of the high pitch sound wave. The sound waves of the left sound track radiated by the first tweeter unit 11 reflects as meeting the first phase cone 161, and enter the horns 141 of the left sound track along the first sound track openings 171. The sound waves of the right sound track radiated by the second tweeter unit 12 reflects as meeting the second phase cone 162, and enter the horns 142 of the right sound track along the second sound track openings 172.

It should be noted that the size and shape of the first phase cone 161 and the second phase cone 162 can be adjusted according to actual needs.

Figure 5:
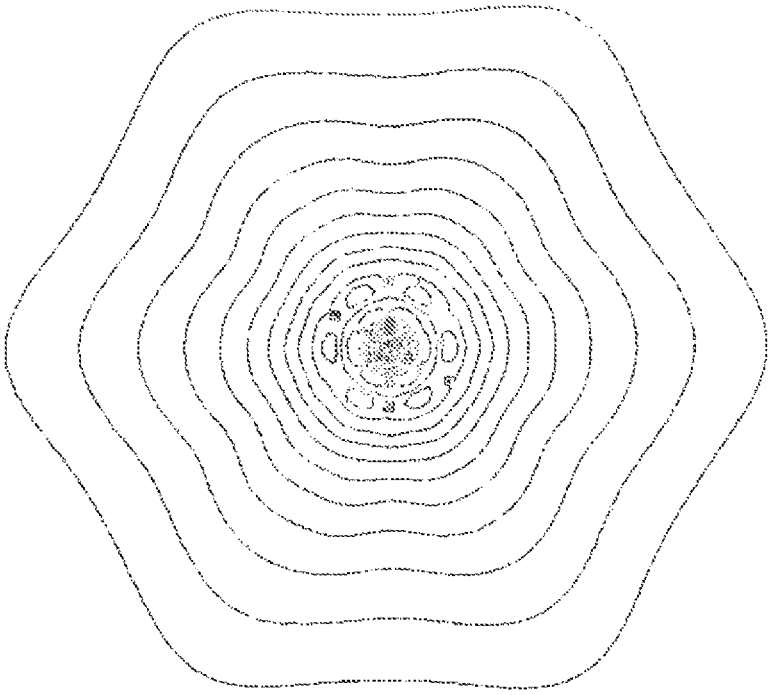
FIG. 5 is a schematic diagram of sound field simulation of a tweeter according to an embodiment of the invention.

In one preferred embodiment, the plurality of horns (141,142) are disposed evenly on whole plane, wherein the number of the horns 141 of the left sound track is two or more, and correspondingly, the number of the horns 142 of the right sound track is also two or more. The more the horns are, the better the effect of omnidirectional sound field would realize. Referring to FIG. 5, it is a schematic diagram of sound field simulation of a tweeter according to an embodiment of the invention, wherein each closed curve represents spatial points under the same sound pressure, projecting points of the sound pressure curve correspond to the center of the ventilation holes of the horns, and recessed points correspond to the partition walls. As can be seen, the more the horns are and the more even the disposition is, the smaller the positional difference between the projecting points and the recessed points would be, and the closer to a round shape the sound pressure curve would be, i.e., the closer to an even sound field covering an horizontal angle of 360°. Preferably, the number of the horns of the left and right sound tracks in this embodiment are six or eight, respectively.

Figure 4:
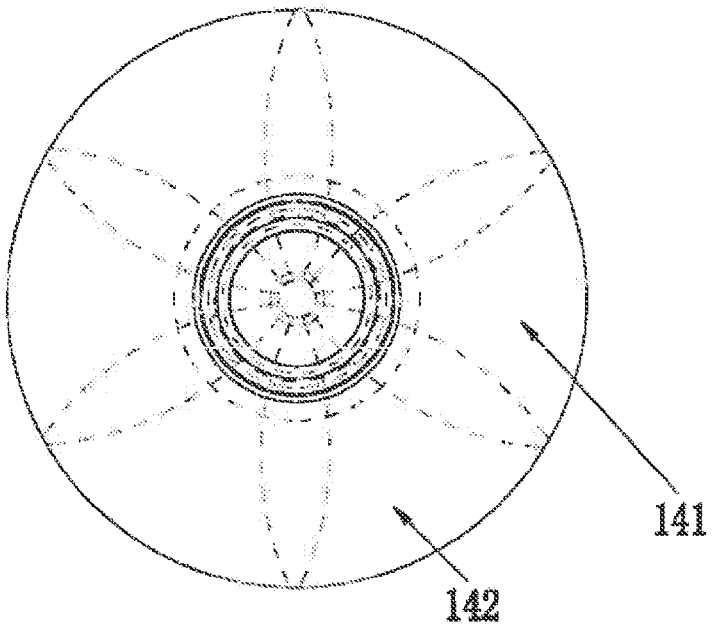
FIG. 4 is a plan view of symmetrical horns in another way according to an embodiment of the invention.

It should be noted that the shape and size of the horns and the partition walls in this technical solution can both be correspondingly adjusted according to the actual needs as long as the sound waves emitted from the ventilation holes of the horns can cover a horizontal angle of 360°. For example, the partition walls of the horns in FIG. 2 partition the horns of the left sound track and the horns of the right sound track into six horns with symmetrical shape and straight line-shaped sidewalls. FIG. 4 is a plan view of symmetrical horns in another way according to an embodiment of the invention. Referring to FIG. 4, the visible partition walls in FIG. 4 partition the horns of the left sound track and the horns of the right sound track into six horns with symmetrical shape and arc-shaped sidewalls, which are different from the horns with straight line-shaped sidewalls of FIG. 2.

In the above embodiment, a central axis of the first tweeter unit 11 coincides with a central axis of the second tweeter unit 12, see the scenes shown in FIGS. 1-4. Namely, the horizontal projection of the first tweeter unit 11 and that of the second tweeter unit 12 overlap each other. In this case, the horns 141 of the left sound track are symmetrical in position with the horns 142 of the right sound track. The central axis of the first tweeter unit 11, the central axis of the second tweeter unit 12, and the central axis of the radiation structure 13 coincide with one another.

However, the technical solution of the present invention comprises but not is limited to that the central axis of the first tweeter unit 11 coincides with the central axis of the second tweeter unit 12. In another embodiment, the central axis of the first tweeter unit 11 may not coincide with the central axis of the second tweeter unit 12. Please see the embodiment commonly shown in FIGS. 6-9 for detail.

It should be noted that no matter the horns 141 of the left sound track are symmetrical in position with the horns 142 of the right sound track or not, the two tweeter units can both be disposed within the radiation structure 13, or, at least part of the tweeter units is disposed within the radiation structure 13. Besides, this embodiment does not constrain that the central axis of the tweeter unit must be a vertical axis. The tweeter units may be tilt disposed relative to horizontal direction according to the change of the shape of the radiation structure.

The tweeter of this embodiment, merely by effectively combining two tweeter units provided for the left and right sound tracks with a radiation structure constituted by the horns of the left and right sound tracks disposed at intervals, has advantages of simple structure, small volume, and low cost, and can realize stereo effect; and by disposing all of the horns evenly on a whole plane, the stereo sound wave emitted from the horns can cover horizontal 360°.

As commonly shown in FIGS. 6-9, another embodiment of the invention provides a tweeter, wherein the central axis of the first tweeter unit 21 does not coincide with the central axis of the second tweeter unit 22. In this case, the horns 241 of the left sound track are not symmetrical in position with the horns 242 of the right sound track, namely, the horizontal projection of the first tweeter unit 21 does not overlap that of the second tweeter unit 22, and the central axis of the first tweeter unit 21, the central axis of the second tweeter unit 22, and the central axis of the radiation structure 23 do not coincide with one another.

Figure 6:
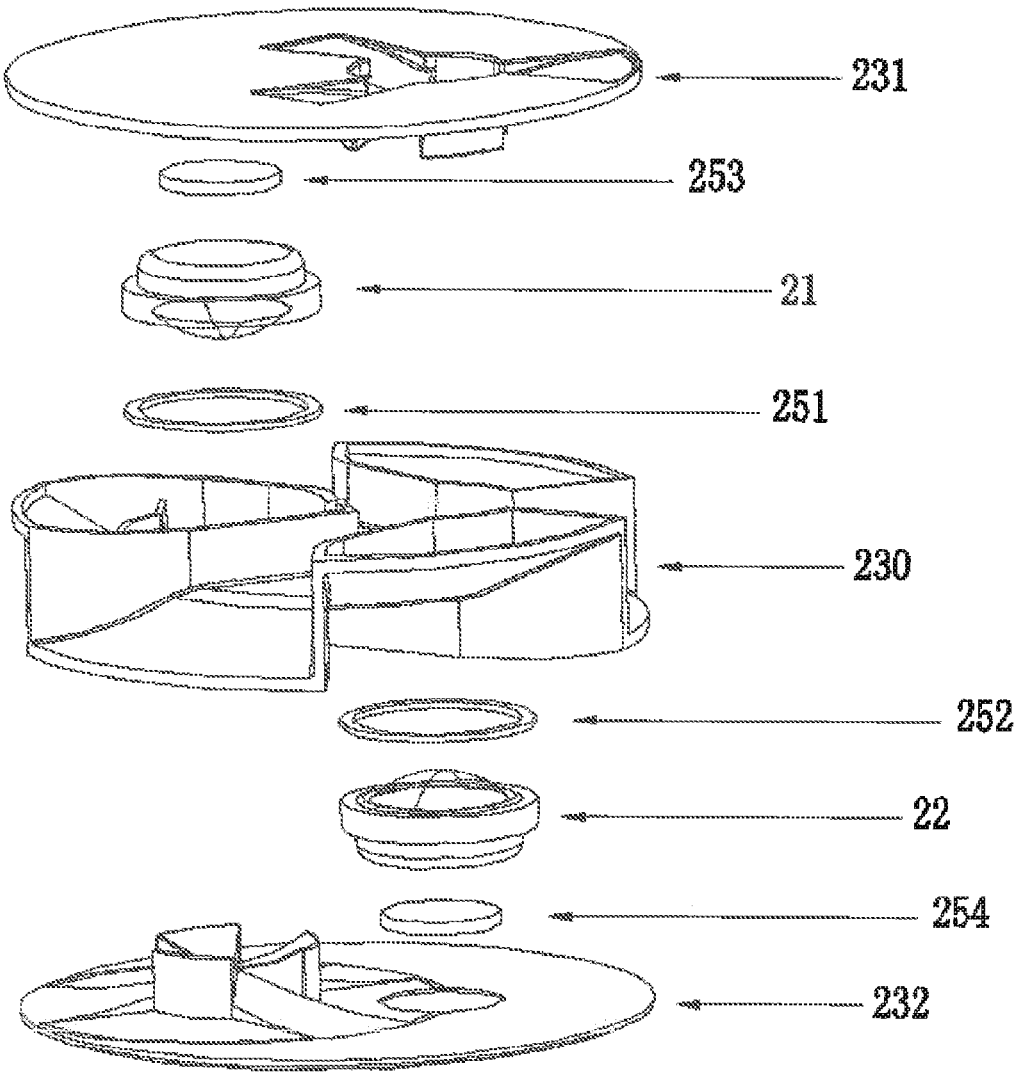
FIG. 6 is an explosive view of the assembly structure of a tweeter provided by another embodiment of the present invention.
Figure 7:
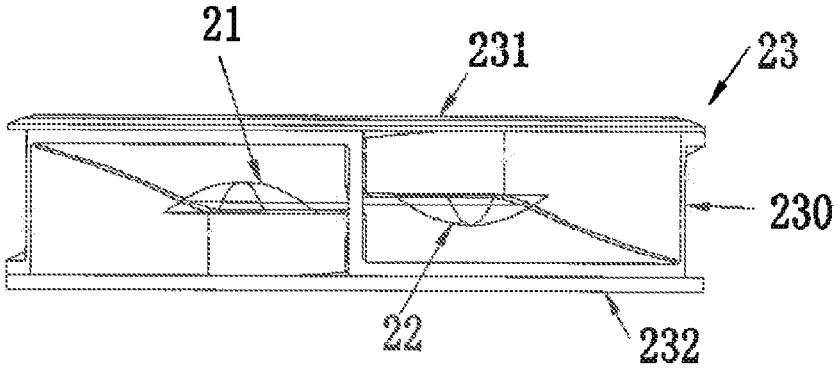
FIG. 7 is a section view of the assembly after the components in FIG. 6 have been assembled.

FIG. 7 is a section view of the assembly after the components in FIG. 6 have been assembled. The radiation structure 23 constituted by a plurality of horns is formed by detached components, comprising an upper structure 231, a lower structure 232 and an intermediate structure 230.

Figure 9:
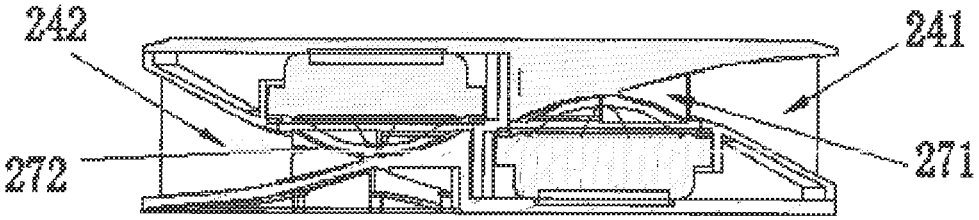
FIG. 9 is a perspective view of the assembly after the components in FIG. 6 have been assembled.

As shown in FIG. 6 and FIG. 7, the first tweeter unit 21 and the second tweeter unit 22 are assembled on the radiation structure 23 via a first sealing foam 251 and a second sealing foam 252, respectively, a third sealing foam 253 seals the gaps generated by directly assembling the upper structure 231 and the intermediate structure 230 of the radiation structure 23, and a fourth sealing foam 254 seals the gaps generated by directly assembling the lower structure 232 and the intermediate structure 230 of the radiation structure 23, to ensure that all of the sound waves of the left sound track of the first tweeter unit 21 enter the horns 241 of the left sound track along the first sound track openings 271, and all of the sound waves of the right sound track of the second tweeter unit 22 enter the horns 242 of the right sound track along the second sound track openings 272. Referring to FIG. 9, it shows a perspective view of the assembly after the components in FIG. 6 have been assembled.

Figure 8:
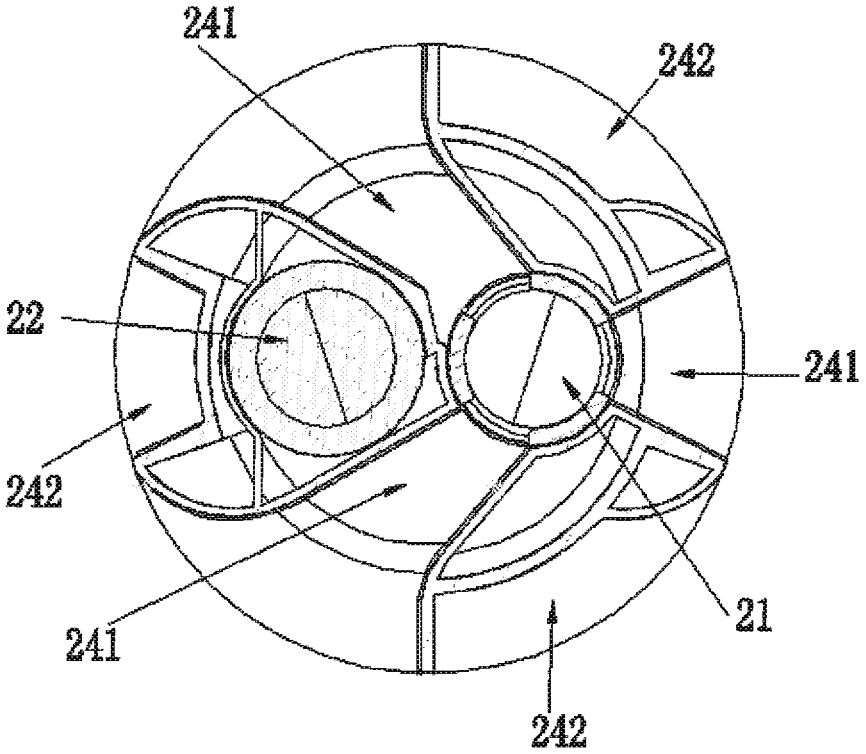
FIG. 8 is a plan view of the radiation structure with the components in FIG. 6 assembled and the upper structure removed.

It should be noted that when the central axis of the first tweeter unit 21 does not coincide with the central axis of the second tweeter unit 22, the horns 241 of the left sound track and the horns of the right sound track are not symmetrical in position. Referring to FIG. 8, it shows a plan view of the radiation structure with the components in FIG. 6 assembled and the upper structure removed. The horizontal projection of the first tweeter unit 21 and that of the second tweeter unit 22 stagger.

Referring to FIG. 7, the first tweeter unit 21 partially overlaps the second tweeter unit 22 in the axial direction. Namely, in the direction vertical to the axial direction, the first tweeter unit 21 and the second tweeter unit 22 have an overlapping portion. Preferably, the total thickness of the radiation structure 23 is less than the sum of the thickness of the first tweeter unit 21 and the thickness of the second tweeter unit 22, thereby ensuring that omnidirectional sound field can be realized with an audio equipment of smaller volume.

In the radiation structure 23, the number of the horns of the left sound track is the same as the number of the horns of the right sound track, the horns 241 of the left sound track and the horns 242 of the right sound track are disposed at intervals, and the thicknesses of the partition walls between the horns can be adjusted according to actual needs.

In an preferred embodiment, as shown in FIG. 8, the horns 241 of the left sound track and the horns 242 of the right sound track are staggered in horizontal, direction, the horns 241 of the left sound track are turned 180° in horizontal direction and then 180° in vertical direction, and finally are consistent in position with the horns 242 of the right sound track.

According to the tweeter provided by this embodiment, the central axis of the first tweeter unit does not coincide with the central axis of the second tweeter unit. By staggering the first tweeter unit from the second tweeter unit in vertical direction, the total thickness of the radiation structure is smaller than the sum of the thickness of the first tweeter unit and the thickness of the second tweeter unit, causing the structure of the whole tweeter more compact.

Figure 10:
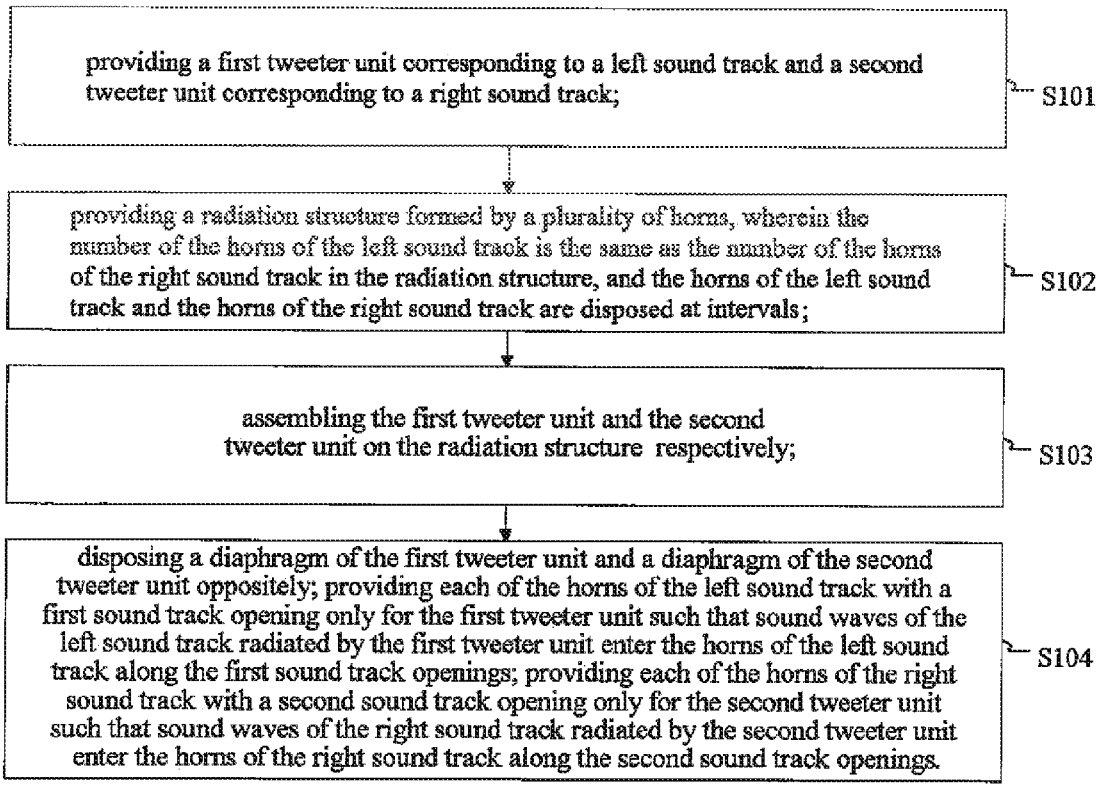
FIG. 10 is a flow chart of a method for realizing omnidirectional high pitch sound field provided by an embodiment of the present invention.

FIG. 10 is a flow chart of a method for realizing omnidirectional high pitch sound field provided by an embodiment of the present invention, the method comprising:

S101, providing a first tweeter unit corresponding to the left sound track and a second tweeter unit corresponding to the right sound track;

S102, providing a radiation structure formed by a plurality of horns, wherein the number of the horns of the left sound track is the same as the number of the horns of the right sound track in the radiation structure, and the horns of the left sound track and the horns of the right sound track are disposed at intervals;

S103, assembling the first tweeter unit and the second tweeter unit respectively on the radiation structure;

S104, disposing a diaphragm of the first tweeter unit and a diaphragm of the second tweeter unit oppositely; providing each of the horns of the left sound track with a first sound track opening only for the first tweeter unit such that sound waves of the left sound track radiated by the first tweeter unit enter the horns of the left sound track along the first sound track openings; providing each of the horns of the right sound track with a second sound track opening only for the second tweeter unit such that sound waves of the right sound track radiated by the second tweeter unit enter the horns of the right sound track along the second sound track openings.

In a preferred embodiment, it further provides a first sealing foam matching the first tweeter unit, and provides a second sealing foam matching the second tweeter unit, wherein the first sealing foam can surround the first tweeter unit without contacting the diaphragm of the first tweeter unit, and the second sealing foam can surround the second tweeter unit without contacting the diaphragm of the second tweeter unit.

Assemble the first tweeter unit and the second tweeter unit on the radiation structure via the first sealing foam and the second sealing foam, respectively.

In another preferred embodiment, it further provides a first phase cone and a second phase cone, wherein the first phase cone is fixed by a support frame symmetrically disposed on the horns of the left sound track and located in front of the diaphragm of the first tweeter unit; and the second phase cone is fixed by a support frame symmetrically disposed on the horns of the right sound track and located in front of the diaphragm of the second tweeter unit. The structure of phase cones helps sound spread more evenly to the horns of both left and right sound tracks. Symmetrical disposition of support frames on the corresponding horns for each of the phase corns helps the sound spread more evenly.

In a preferred solution, dispose the plurality of horns evenly on a whole plane, wherein the number of the horns of the left sound track is two or more, and correspondingly, the number of the horns of the right sound track is also two or more. Apparently, the more the horns are, the better the effect of omnidirectional sound field would be. Preferably, the number of the horns of the left and right sound tracks in this embodiment are six or eight, respectively. By disposing all of the horns evenly on a whole plane, the stereo sound wave emitted from the horns can cover horizontal 360°

It should be noted that in the above solution, the central axis of the first tweeter unit may coincide with the central axis of the second tweeter unit, or, the central axis of the first tweeter unit may not coincide with the central axis of the second tweeter unit.

When the central axis of the first tweeter unit coincides with the central axis of the second tweeter unit, it is preferably disposed that the horns of the left sound track and the horns of the right sound track are symmetrical in position.

When the central axis of the first tweeter unit does not coincide with the central axis of the second tweeter unit, it may be disposed that the horns of the left sound track and the horns of the right sound track are not symmetrical in position; preferably, the horns of the left sound track are turned 180° in horizontal direction and then 180° in vertical direction, and finally are consistent in position with the horns of the right sound track.

When the central axis of the first tweeter unit does not coincide with the central axis of the second tweeter unit, it may also be disposed that the first tweeter unit partially overlaps the second tweeter unit in the axial direction. Preferably, the total thickness of the radiation structure is less than the sum of the thickness of the first tweeter unit and the thickness of the second tweeter unit, thereby ensuring that omnidirectional sound field can be realized with an audio equipment of smaller volume.

The specific implementation of steps of the method in the embodiment of the present invention can be referred to the specific contents of the embodiment of the tweeter of the present invention, and it will not be repeated herein.

To sum up, the embodiments of the present invention provide a tweeter and a method for realizing omnidirectional high pitch sound field. The tweeter comprises a first tweeter unit corresponding to the left sound track, a second tweeter unit corresponding to the right sound track, a radiation structure formed by a plurality of horns, and it has advantages of simple structure, small volume and low cost. By disposing the horns of the left sound track and the horns or the right sound track at intervals, the tweeter has stereo effect. By disposing all of the horns evenly on a whole plane, the sound wave emitted by the horns can cover horizontal 360° Therefore, it effectively solves the problem that the acoustic structure in the prior art cannot realize 360° surround stereo under the general request of miniaturization and low cost.

What is described above is only better embodiments of the present invention and is not intended to limit the scope of the present invention. Accordingly, any modifications, equivalents and improvements within the spirits and principles of the present invention are included in the protection scope of the present invention.

The invention claimed is:

1. A tweeter, comprising:

a first tweeter unit corresponding to a left sound track, a second tweeter unit corresponding to a right sound track, and a radiation structure formed by a plurality of horns;

the number of the horns of the left sound track is the same as the number of the horns of the right sound track in the radiation structure, and the horns of the left sound track and the horns of the right sound track are disposed at intervals via partition walls; and the first tweeter unit and the second tweeter unit are assembled on the radiation structure respectively, a diaphragm of the first tweeter unit and a diaphragm of the second tweeter unit are disposed oppositely, each of the horns of the left sound track is provided with a first sound track opening only for the first tweeter unit, sound waves of the left sound track radiated by the first tweeter unit enter the horns of the left sound track along the first sound track openings; each of the horns of the right sound track is provided with a second sound track opening only for the second tweeter unit, sound waves of the right sound track radiated by the second tweeter unit enter the horns of the right sound track along the second sound track openings;

a first phase cone and a second phase cone, the first phase cone is fixed by a support frame symmetrically disposed on the horns of the left sound track and located in front of the diaphragm of the first tweeter unit and the second phase cone is fixed by a support frame symmetrically disposed on the horns of the right sound track and located in front of the diaphragm of the second tweeter unit.

2. The tweeter according to claim 1, characterized in that the plurality of horns are disposed evenly on a whole plane, wherein the number of the horns of the left sound track is two or more, and correspondingly, the number of the horns of the right sound track is also two or more.

3. The tweeter according to claim 1, characterized in that the tweeter further comprises: a first sealing foam matching the first tweeter unit, and a second sealing foam matching the second tweeter unit, wherein the first sealing foam can surround the first tweeter unit without contacting the diaphragm of the first tweeter unit, and the second sealing foam can surround the second tweeter unit without contacting the diaphragm of the second tweeter unit; and the first tweeter unit and the second tweeter unit are assembled on the radiation structure via the first sealing foam and the second sealing foam respectively.

4. The tweeter according to claim 1, characterized in that a central axis of the first tweeter unit coincides with a central axis of the second tweeter unit, or, a central axis of the first tweeter unit does not coincide with a central axis of the second tweeter unit.

5. The tweeter according to claim 4, characterized in that when the central axis of the first tweeter unit coincides with the central axis of the second tweeter unit, the horns of the left sound track and the horns of the right sound track are symmetrical in position.

6. The tweeter according to claim 4, characterized in that when the central axis of the first tweeter unit does not coincide with the central axis of the second tweeter unit, the horns of the left sound track and the horns of the right sound track are not symmetrical in position.

7. The tweeter according to claim 6, characterized in that when the horns of the left sound track and the horns of the right sound track are not symmetrical in position, the horns of the left sound track are turned 180° in horizontal direction and then 180° in vertical direction, and finally are consistent in position with the horns of the right sound track.

8. The tweeter according to claim 4, characterized in that when the central axis of the first tweeter unit does not coincide with the central axis of the second tweeter unit, the first tweeter unit partially overlaps the second tweeter unit in the axial direction.

9. A method for realizing omnidirectional high pitch sound field, comprising the steps of:

providing a first tweeter unit corresponding to a left sound track and a second tweeter unit corresponding to a right sound track;

providing a radiation structure formed by a plurality of horns, wherein the number of the horns of the left sound track is the same as the number of the horns of the right sound track in the radiation structure, and the horns of the left sound track and the horns of the right sound track are disposed at intervals via partition walls;

assembling the first tweeter unit and the second tweeter unit on the radiation structure respectively;

disposing a diaphragm of the first tweeter unit and a diaphragm of the second tweeter unit oppositely;

providing each of the horns of the left sound track with a first sound track opening only for the first tweeter unit such that sound waves of the left sound track radiated by the first tweeter unit enter the horns of the left sound track along the first sound track openings;

providing each of the horns of the right sound track with a second sound track opening only for the second tweeter unit such that sound waves of the right sound track radiated by the second tweeter unit enter the horns of the right sound track along the second sound track openings; and disposing a first phase cone and a second phase cone, wherein the first phase cone is fixed by a support frame symmetrically disposed on the horns of the left sound track and located in front of the diaphragm of the first tweeter unit; and the second phase cone is fixed by a support frame symmetrically disposed on the horns of the right sound track and located in front of the diaphragm of the second tweeter unit.

10. The method according to claim 9, characterized in that the method further comprises:

disposing the plurality of horns evenly on a whole plane, wherein the number of the horns of the left sound track is two or more, and correspondingly, the number of the horns of the right sound track is also two or more.

11. The method according to claim 9, characterized in that the method further comprises:

disposing a first sealing foam matching the first tweeter unit, and disposing a second sealing foam matching the second tweeter unit, wherein the first sealing foam can surround the first tweeter unit without contacting the diaphragm of the first tweeter unit, and the second sealing foam can surround the second tweeter unit without contacting the diaphragm of the second tweeter unit;

said assembling the first tweeter unit and the second tweeter unit on the radiation structure respectively comprises:

assembling the first tweeter unit and the second tweeter unit on the radiation structure via the first sealing foam and the second sealing foam respectively.

12. The method according to claim 9, characterized in that a central axis of the first tweeter unit coincides with a central axis of the second tweeter unit, or, a central axis of the first tweeter unit does not coincide with a central axis of the second tweeter unit.

13. The method according to claim 12, characterized in that the method further comprises:

when the central axis of the first tweeter unit coincides with the central axis of the second tweeter unit, disposing the horns of the left sound track and the horns of the right sound track to be symmetrical in position; and when the central axis of the first tweeter unit does not coincide with the central axis of the second tweeter unit, disposing the horns of the left sound track and the horns of the right sound track to be not symmetrical in position, or disposing the first tweeter unit to partially overlap the second tweeter unit in the axial direction.

14. A tweeter, comprising:

a first tweeter unit corresponding to a left sound track, a second tweeter unit corresponding to a right sound track, and a radiation structure formed by a plurality of horns;

the number of the horns of the left sound track is the same as the number of the horns of the right sound track in the radiation structure, and the horns of the left sound track and the horns of the right sound track are disposed at intervals via partition walls;

the first tweeter unit and the second tweeter unit are assembled on the radiation structure respectively, a diaphragm of the first tweeter unit and a diaphragm of the second tweeter unit are disposed oppositely, each of the horns of the left sound track is provided with a first sound track opening only for the first tweeter unit, sound waves of the left sound track radiated by the first tweeter unit enter the horns of the left sound track along the first sound track openings;

each of the horns of the right sound track is provided with a second sound track opening only for the second tweeter unit, sound waves of the right sound track radiated by the second tweeter unit enter the horns of the right sound track along the second sound track openings;

a first sealing foam matching the first tweeter unit, and a second sealing foam matching the second tweeter unit; wherein the first sealing foam can surround the first tweeter unit without contacting the diaphragm of the first tweeter unit, and the second sealing foam can surround the second tweeter unit without contacting the diaphragm of the second tweeter unit; and the first tweeter unit and the second tweeter unit are assembled on the radiation structure via the first sealing foam and the second sealing foam, respectively.

* * * * *